US011391041B2

(12) United States Patent
Radford

(10) Patent No.: US 11,391,041 B2
(45) Date of Patent: Jul. 19, 2022

(54) UNIBODY STRUCTURAL FRAME FOR AN INTERLOCKING STRUCTURAL BLOCK, AN INTERLOCKING STRUCTURAL BLOCK, AND A SYSTEM OF INTERLOCKING STRUCTURAL BLOCKS

(71) Applicant: JUST BIOFIBER STRUCTURAL SOLUTIONS CORP., Calgary (CA)

(72) Inventor: William Malcolm Radford, Airdrie (CA)

(73) Assignee: JUST BIOFIBER STRUCTURAL SOLUTIONS CORP., Calgary (CA)

( * ) Notice: Subject to any disclaimer, the term of this patent is extended or adjusted under 35 U.S.C. 154(b) by 0 days.

(21) Appl. No.: 16/361,997

(22) Filed: Mar. 22, 2019

(65) Prior Publication Data

US 2020/0109557 A1 Apr. 9, 2020

Related U.S. Application Data

(60) Provisional application No. 62/740,849, filed on Oct. 3, 2018.

(51) Int. Cl.

| | |
|---|---|
| ***E04B 2/18*** | (2006.01) |
| ***E04B 2/16*** | (2006.01) |
| *E04B 2/02* | (2006.01) |

(52) U.S. Cl.

CPC ..... *E04B 2/16* (2013.01); *E04B 2002/0243* (2013.01); *E04B 2002/0278* (2013.01)

(58) Field of Classification Search

CPC ..... E04B 2/18; E04B 2/24; E04B 2002/0206; E04B 2/16; E04B 2002/0278; E04C 2/041

See application file for complete search history.

(56) References Cited

U.S. PATENT DOCUMENTS

| | | | | |
|---|---|---|---|---|
| 3,618,279 | A * | 11/1971 | Sease | E04B 2/46 52/223.7 |
| 5,987,840 | A | 11/1999 | Leppert | |
| 6,996,945 | B2 * | 2/2006 | Doty | E04B 2/18 52/582.1 |
| 9,957,987 | B2 * | 5/2018 | Wandkowski | E03F 1/00 |
| 2007/0227094 | A1 * | 10/2007 | Oscar | B65D 90/027 52/630 |
| 2008/0272270 | A1 * | 11/2008 | Robin | B28B 3/022 249/18 |
| 2009/0120030 | A1 * | 5/2009 | Garza | E04C 5/20 52/686 |
| 2016/0194874 | A1 * | 7/2016 | Radford | E04B 7/22 52/600 |
| 2017/0030069 | A1 | 2/2017 | Radford | |

FOREIGN PATENT DOCUMENTS

| | | | |
|---|---|---|---|
| CA | 2899465 | A1 | 2/2016 |
| CA | 2899473 | A1 | 2/2016 |
| CA | 2899476 | A1 | 2/2016 |
| DE | 1044379 | B | 11/1958 |

* cited by examiner

*Primary Examiner* — Brian E Glessner
*Assistant Examiner* — Daniel J Kenny
(74) *Attorney, Agent, or Firm* — Bennett Jones LLP

(57) ABSTRACT

A unibody structural frame for an interlocking structural block, an interlocking structural block, and a system of interlocking structural blocks useful for the manufacture of structures, columns, and beams.

10 Claims, 5 Drawing Sheets

Fig 5
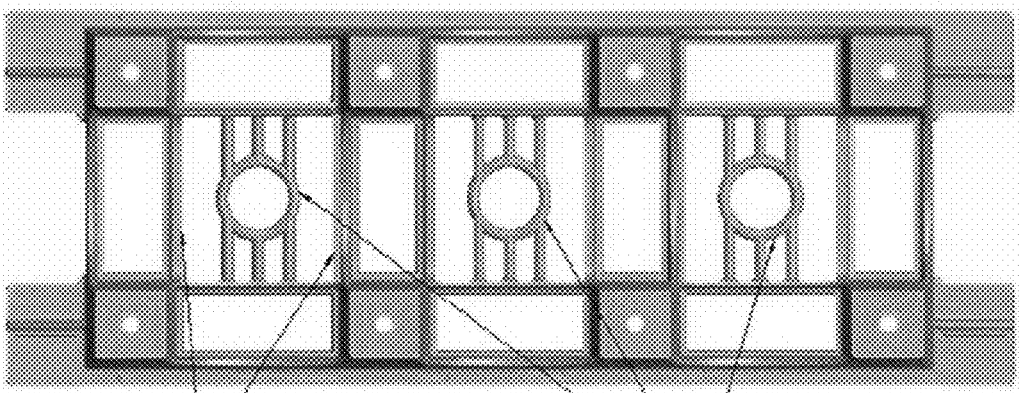
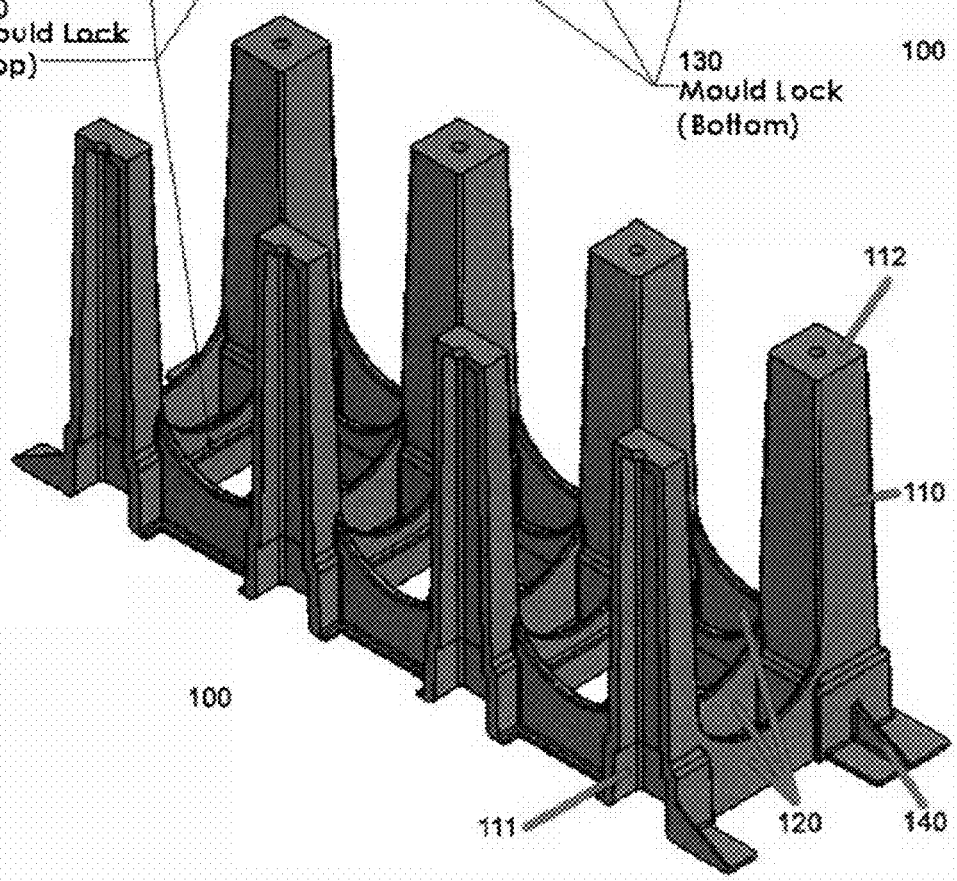
Fig 6

UNIBODY STRUCTURAL FRAME FOR AN INTERLOCKING STRUCTURAL BLOCK, AN INTERLOCKING STRUCTURAL BLOCK, AND A SYSTEM OF INTERLOCKING STRUCTURAL BLOCKS

This application claims priority to U.S. Provisional patent application Ser. No. 62/740,849 filed Oct. 3, 2018.

BACKGROUND

There are various building blocks used in construction of buildings in the prior art, which include self-alignment pins or included reinforcement means. We refer the reader some prior patent applications of this inventor as examples: CA 2899473; CA 2899465; CA 2899476 and U.S. Ser. No. 14/815,836.

Generally, the prior art over which the invention is an improvement include blocks made of a matrix material which surround embedded elements, the elements which provide one of: compression load-bearing reinforcement; self-alignment of blocks when stacked into courses to form a panel; or post-tensioning anti-deformation means embedded within a panel formed of the blocks. Other examples of prior art include walls formed of stacked cinder blocks into cavities of which reinforcements may be inserted and cement or some other strengthening material may be poured.

The invention disclosed here provides improvements over this prior art.

SUMMARY

The frames are each embedded within a matrix of material which forms a construction block for assembly at a site into a wall or other panel. The frames provide interlocking elements within the wall or other panel, while the matrix material may be tailored to provide insulation, fire resistance, waterproofing, or some additional or other functionality to the wall or panel, and hence to the building being constructed using the blocks with these frames.

In accordance with a broad aspect of the invention, there is provided a unibody structural frame for an interlocking structural block comprising a plurality of struts connected with a web, each strut having a top portion, an outer surface, and an inner surface, wherein each strut is configured for engagement within a recess of the strut of another unibody structural frame, the web holding the struts in relative rigid spacial symmetry and thus preventing the struts from rotation or translation about any axis with respect to any other strut attached to the web; an opening at the bottom end of each strut, the opening configured for engagement with the top portion of the outer surface of a strut of an adjacent structural block; a plurality of webs extending in a first direction, each web having a first end and a second end, wherein each web is connected to one or more struts; and a plurality of webs extending in a substantially orthogonal direction to the first direction, each web having a first end and a second end, wherein each web is connected to one or more of the struts.

In accordance with another broad aspect of the invention, there is provided an interlocking structural block comprising a block body having opposed top and bottom surfaces, opposed side surfaces and opposed end surfaces; and a unibody structural frame embedded within the block body, one end of the unibody structural frame flush with the bottom surface and an opposite end of the unibody structural frame extending through the top surface of the block body.

In accordance with another broad aspect of the invention, there is provided a system of interlocking structural blocks comprising a plurality of interlocking structural blocks connected through one or more struts of one block to one or more struts of an adjacent block.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly, the drawings and detailed description are to be regarded as illustrative in nature and not as restrictive.

Some advantages of the present invention are that the components may be manufactured and assembled in a factory, which allows for prefabrication under controlled systems using automated equipment. This avoids idiosyncratic assembly errors on-site. This permits less waste; stronger, faster and more accurate installation of walls and other panels; and use of less skilled labour.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIG. 5 is a top view of a unibody structural frame.

FIG. 6 is a perspective sectional view of a unibody structural frame.

FIGURE LABELS

Figure 1:
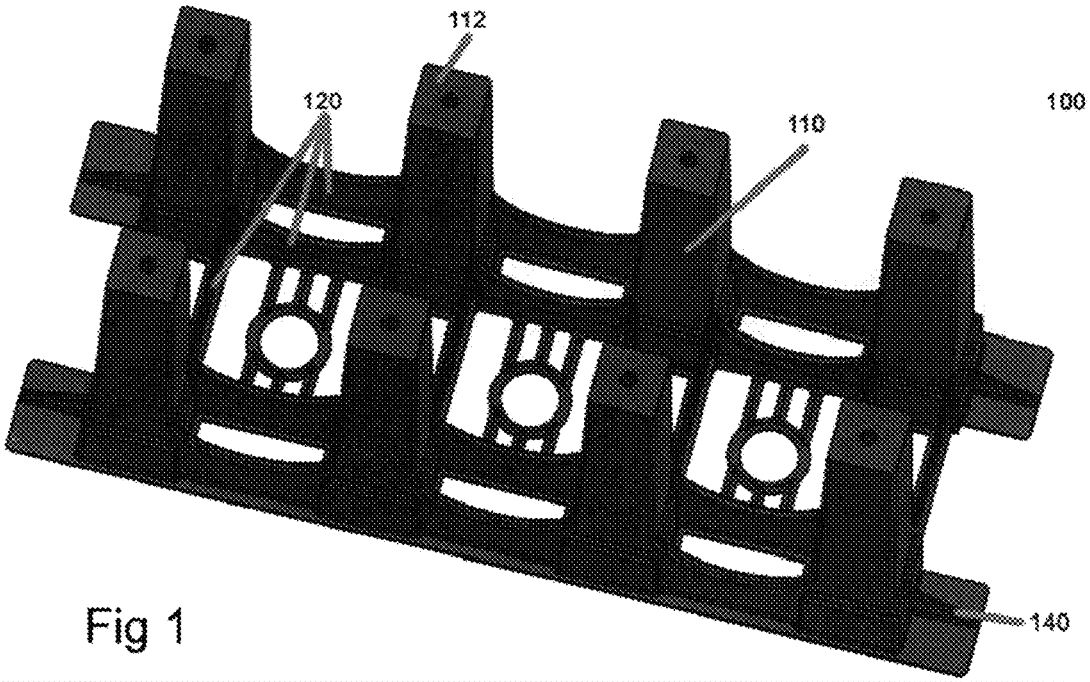
FIG. 1 is a perspective top view of a unibody structural frame.
Figure 2:
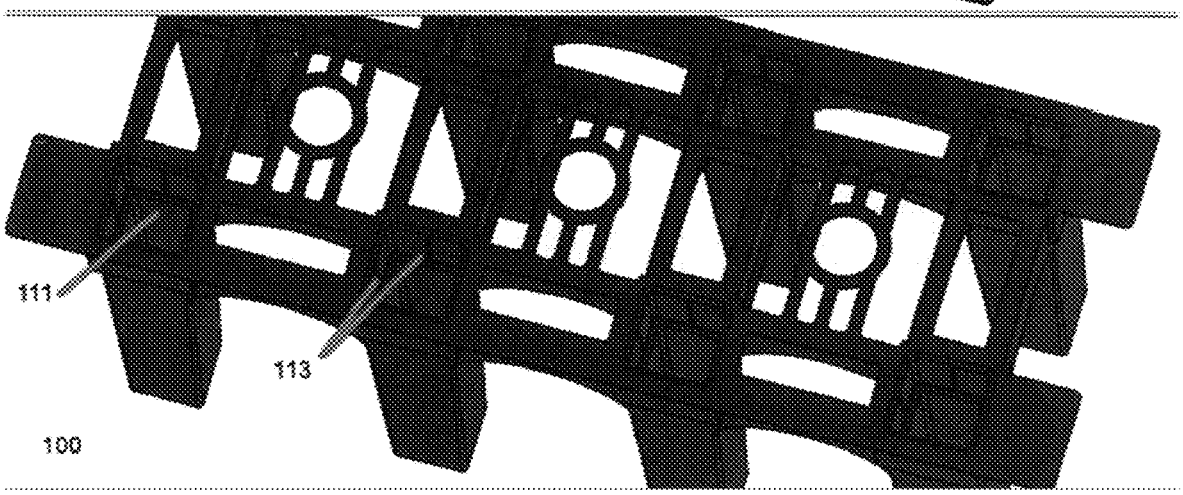
FIG. 2 is a perspective bottom-view of a unibody structural frame.
Figures 3, 4:
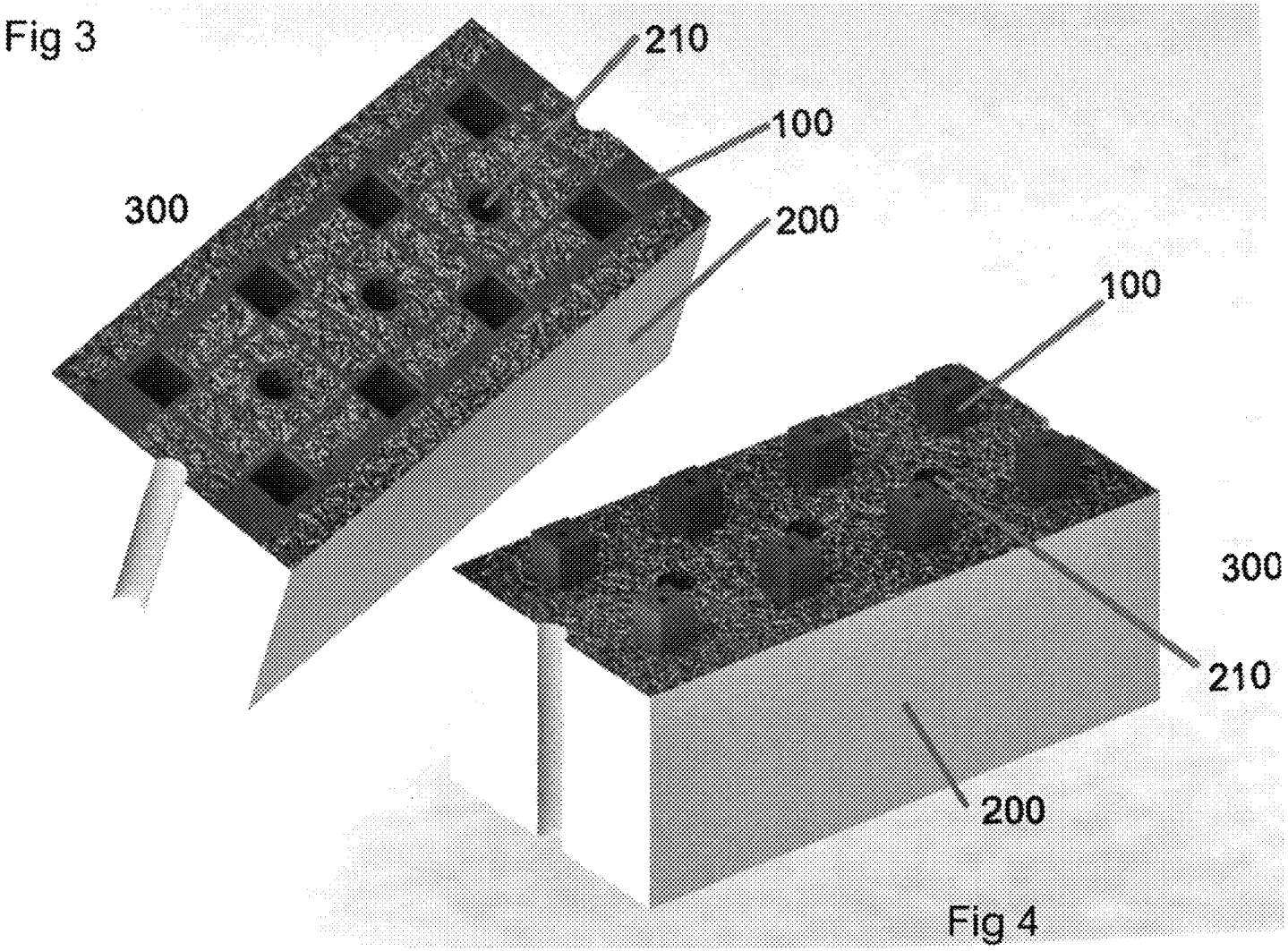
FIG. 3 is a perspective bottom view of an interlocking structural block.
FIG. 4 is a perspective top view of an interlocking structural block.
Figure 7:
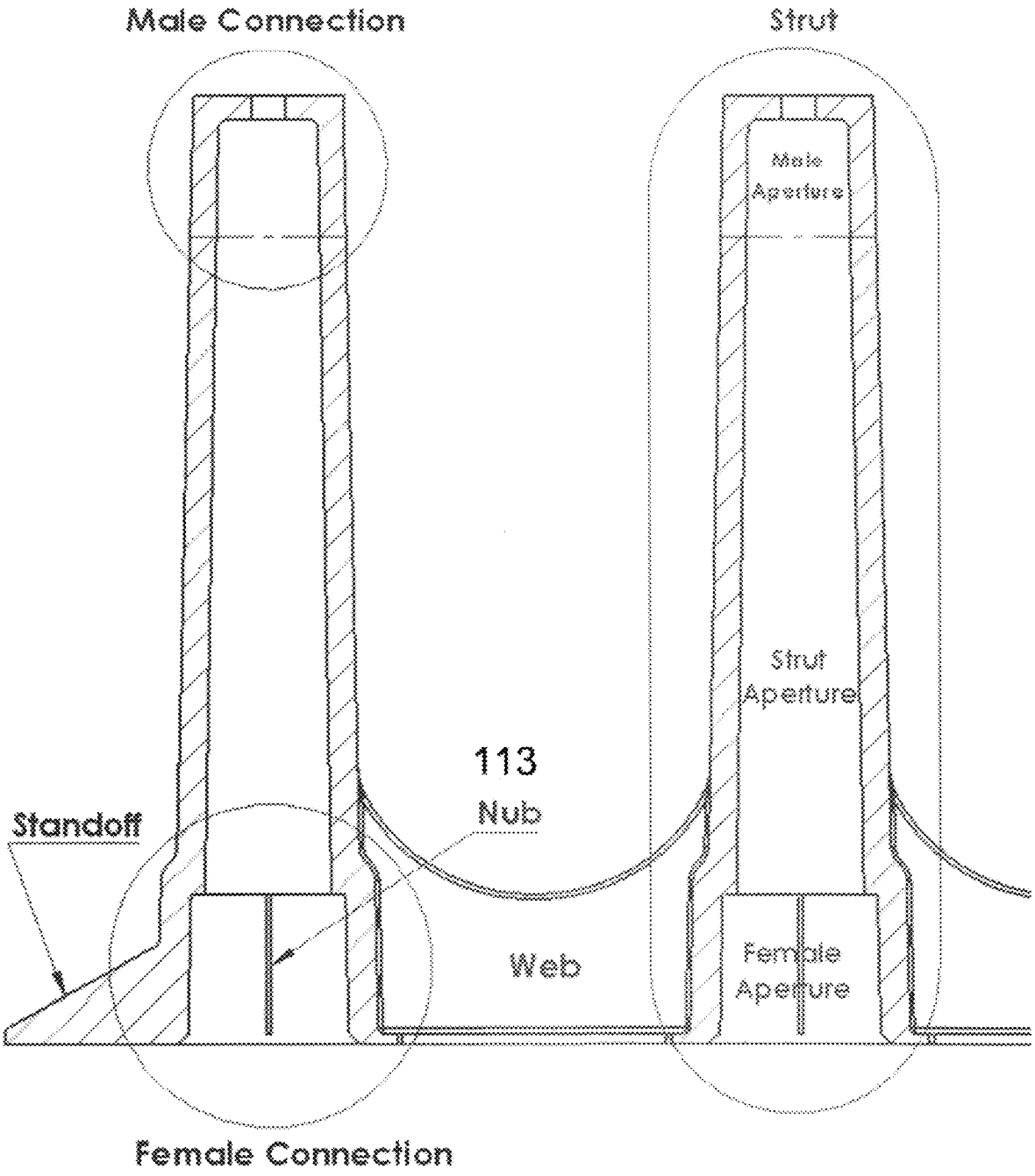
FIG. 7 is a cross sectional view of a unibody structural frame.
Figure 8:
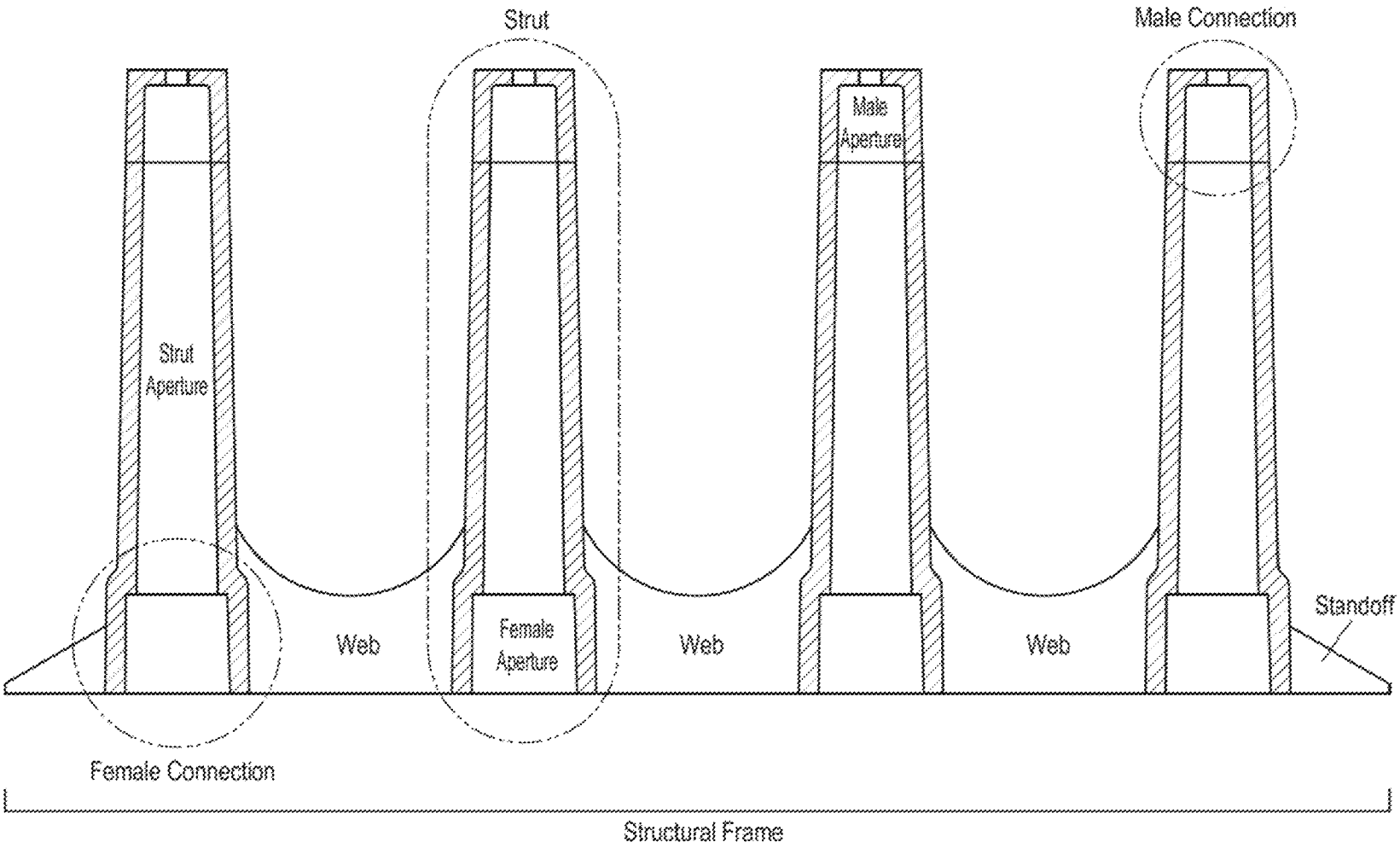
FIG. 8 is a cross sectional view of a unibody structural frame.

100 Unibody Structural Frame
110 Strut
111 Strut Recess
112 Strut Top Portion
113 Spacer Rib
120 Web
130 Mold Locks/Overhanging ribs
140 Standoffs
200 Block Body
210 Conduit Holes
300 Interlocking Structural Block
400 System of Interlocking Structural Blocks

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The invention provides a unibody structural frame 100 for an interlocking structural block 300. The unibody structural frame has a plurality of struts 110 connected with a web 120, each strut having a top portion 112, outer surface and an inner surface and struts may be hollow tubes or cylinders. Each strut is configured for engagement within a recess 111 of the strut of another unibody structural frame. The web holds the struts in relative rigid spacial symmetry and thus prevents the struts from rotating about any axis with respect to any other strut attached to the web. There is an opening at the bottom end of each strut configured for engagement with the top portion of the outer surface of a strut of an adjacent structural block. The unibody structural frame further includes a plurality of webs 120 that extend in a first direction as a vertical elongated flat part from the bottom of the interlocking structural frame. Each web has a first end and a second end, wherein each web is connected to one or more struts. The unibody structural frame has another plurality of webs extending in a substantially orthogonal direction to the first direction, each web having a first end and a second end, wherein each web is connected to one or more of the struts.

In one embodiment, the strut is a hollow shell, having one or more side surfaces, an aperture in the bottom surface, and a top portion with or without an aperture in the top portion.

In one embodiment, the top portion of a strut engages with a stepped portion of the bottom of another strut of an adjacent structural block. Where there is an aperture in the top portion, tension means may be placed between the blocks.

In one embodiment, the webs locate and lock the struts relative to each other in both translation and rotation.

In one embodiment, the struts and webs are formed simultaneously during the manufacturing process.

In one embodiment, spacer ribs 113 are included along the inner surface of the strut for alignment and adhesive spacing.

In one embodiment, there are overhanging ribs 130, or mold locks, on the side surfaces of the webs.

In one embodiment, standoffs 140 are formed on opposing ends of the unibody structural frame.

In one embodiment, the plurality of struts, one or more webs, and one or more side surfaces are formed from one or more of: metallic materials, iron, steel, stainless steel, polymeric materials, silicone rubber, polyethylene, acrylic resins, polyurethane polypropylene, polymethylmethacrylate, synthetic and natural biodegradable polymers, biopolyesters, agro-polymers, copolymers, fiber reinforced plastics, composites, wooden materials, or any combination thereof.

In one embodiment, the interlocking structural block has a block body 200 with opposed top and bottom surfaces, opposed side surfaces and opposed end surfaces. The block body includes a unibody structural frame 100 embedded within the block body, one end of the unibody structural frame flush with the bottom surface and an opposite end of the unibody structural frame extending through the top surface of the block body.

In one embodiment, the struts are substantially square in cross section.

In one embodiment, the block body further includes one or more conduit voids 210 for accommodating electrical wiring, piping or utilities. In such an embodiment, the unibody structural frame further includes a ring to align with each conduit. The ring may be held to the web with small attachment elements, which also are designed to hold the block body material from falling through the frame prior to the body material being fully cured.

The invention further provides a system of interlocking structural blocks 400. The system includes a plurality of interlocking structural blocks 300 connected through one or more struts of one block to one or more struts of an adjacent block.

In one embodiment, the engagement of struts from adjacent unibody structural frames are joined together and fixed in place relative to each other through an adhesive agent.

In one embodiment, the adhesive agent includes one or more of epoxy, acrylic, cyanoacrylate, urethane, or silicone.

In one embodiment, the adjacent surfaces of two block bodies are joined together through the use of a mortar agent.

In one embodiment, the mortar agent includes one or more of lime mortar, polymer based agent, cement, or plaster.

In one embodiment, the interlocking structural block is used in the manufacture of a panel or wall structure.

In one embodiment, the interlocking structural block is used in the manufacture of a column or beam.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A unibody structural frame for an interlocking structural block comprising:

a plurality of struts connected with a web, each strut having a top portion, an outer surface, and an inner surface, wherein each strut is configured for engagement of a top portion of one frame within a recess of the inner surface of the strut of another unibody structural frame, the web holding the struts to which it is connected in relative rigid spacial symmetry and thus preventing the struts from rotation or translation about any axis with respect to any other strut connected to the same web;

an opening into the inner surface of a strut at the bottom end of each strut, the opening configured for engagement with the top portion of the outer surface of a strut of an adjacent structural block;

the web including a plurality of lengthwise web members extending in a first direction; and a plurality of cross members extending in a substantially orthogonal direction to the first direction;

each member of the plurality of lengthwise web members and of the plurality of cross members having a first end and a second end, wherein each member is connected to two adjacent struts, and wherein each member has a first, bottom flat edge, and a second, upper and opposite arcuate web edge providing more attachment length at a joint between an edge of the web and the strut to which that edge attaches, and less material in the web nearer a centre point between the two struts to which the web is attached;

wherein at least a pair of the lengthwise web members extends between each adjacent pair of struts and further comprising a lengthwise opening between the pair of the lengthwise web members; and wherein at least a pair of the cross members extends between each adjacent pair of struts and further comprising a widthwise opening between the pair of the cross members.

2. The unibody structural frame of claim 1, wherein the strut is a hollow shell, having one or more side surfaces, an aperture in a bottom surface, and a top portion.

3. The unibody structural frame of claim 2, wherein spacer ribs are located along the inner surface in the bottom surface aperture of the strut for alignment and adhesive spacing.

4. The unibody structural frame of claim 2, wherein the plurality of struts, web, and one or more side surfaces are formed from one or more of: metallic materials, iron, steel, stainless steel, silicone rubber, polyethylene, acrylic resins, polyurethane polypropylene, polymethylmethacrylate, synthetic and natural biodegradable polymers, biopolyesters, agro-polymers, copolymers, fiber reinforced plastics, composites, wooden materials, or any combination thereof.

5. The unibody structural frame of claim 2, further comprising a second aperture in the top portion.

6. The unibody structural frame of claim 1, wherein the top portion of a strut is configured to engage with a stepped portion of the bottom of another strut of an adjacent structural block.

7. The unibody structural frame of claim 1, wherein the web locates and locks the struts relative to each other in both translation and rotation.

8. The unibody structural frame of claim 1, wherein the struts and web are formed simultaneously during the manufacturing process.

9. The unibody structural frame of claim 1, wherein there are overhanging ribs or mold locks, on the side surfaces of the web.

10. The unibody structural frame of claim 1, wherein standoffs are formed on opposing ends of the structural frame.

* * * * *